US007049562B2

(12) United States Patent
Tanino et al.

(10) Patent No.: US 7,049,562 B2
(45) Date of Patent: May 23, 2006

(54) INDUCTION HEATING DEVICE, INDUCTION HEATING FIXING DEVICE AND IMAGE FORMING APPARATUS

(75) Inventors: Ken Tanino, Ibaraki (JP); Makoto Fujii, Hino (JP); Yasuhiro Ohno, Ibaraki (JP); Masami Miyazaki, Itami (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 0 days.

(21) Appl. No.: 10/810,889

(22) Filed: Mar. 29, 2004

(65) Prior Publication Data

US 2005/0067407 A1 Mar. 31, 2005

(30) Foreign Application Priority Data

Sep. 30, 2003 (JP) ..... 2003-339749

(51) Int. Cl.
*H05B 6/14* (2006.01)

(52) U.S. Cl. ..... 219/619; 399/69

(58) Field of Classification Search ..... 219/619, 219/216; 399/69, 70, 328–331, 333, 334
See application file for complete search history.

(56) References Cited

U.S. PATENT DOCUMENTS

| | | | | |
|---|---|---|---|---|
| 6,320,168 | B1 | 11/2001 | Kimata et al. | |
| 6,882,807 | B1 * | 4/2005 | Sakagami | 399/69 |
| 2002/0007752 | A1 | 1/2002 | Sakagami | |
| 2002/0039504 | A1 * | 4/2002 | Nakayama et al. | 399/328 |
| 2003/0062363 | A1 * | 4/2003 | Takagi et al. | 219/619 |

FOREIGN PATENT DOCUMENTS

| | | |
|---|---|---|
| JP | 08-016006 | 1/1996 |
| JP | 09-18527 | 7/1997 |
| JP | 10-198217 | 7/1998 |
| JP | 2002-093566 | 3/2002 |
| JP | 2003-086344 | 3/2003 |

* cited by examiner

*Primary Examiner*—Quang Van
(74) *Attorney, Agent, or Firm*—Morrison & Foerster LLP

(57) ABSTRACT

An induction heating device for inductively heating an object to be heated which is formed of conductive material has a holder. The device also has a coil for inductively heating the object. The coil is supported by the holder. The coil is composed of a plurality of turns of conductor forming a layer, which is positioned along the object. Between conductor sections of the coil through which electric currents respectively flow in the same direction is formed a gap through which temperature of the object is detected. The device is capable of accurately detecting the temperature of heating region of the object, at low cost, and capable of increasing stability and safety in control of the temperature.

6 Claims, 10 Drawing Sheets

INDUCTION HEATING DEVICE, INDUCTION HEATING FIXING DEVICE AND IMAGE FORMING APPARATUS

This application is based on an application No.2003-339749 filed in Japan, the contents of which are hereby incorporated by reference.

BACKGROUND OF THE INVENTION

The present invention relates to an induction heating device for inductively heating an object to be heated which is formed of conductive material.

The invention also relates to an induction heating fixing device of induction heating type for fixing to a sheet a toner image formed on the sheet while conveying the sheet.

The invention also relates to an image forming apparatus having an image forming unit for forming a toner image on a sheet and an induction heating fixing device of induction heating type for fixing to the sheet the toner image formed on the sheet while conveying the sheet having the toner image formed thereon by the image forming unit. Among image forming apparatus of this type are copying machines, laser printers, facsimiles and the like, typically.

Recently, fixing devices of induction heating type that achieve high thermal conversion efficiencies have been proposed in terms of energy saving.

For example, a fixing device disclosed in patent literature (Japanese Patent Laid-Open Publication 2002-93566) has a heating roller (a member to be heated including a metal sleeve) that is rotated by a motor, a pressurizing roller that is in pressure contact with the heating roller, and a coil that is provided along part of outer periphery of the heating roller and that is tightly wound so as to form a layer. A thermistor (temperature detecting means) is provided so as to face a part of the outer periphery of the heating roller wherein the part is far from a region which the coil faces. In operation, a high-frequency current is fed through the coil and the heating roller is heated by an induced current (eddy current) caused thereby. The temperature of the heating roller is controlled so as to be held at a predetermined temperature on basis of detection signal from the thermistor. A sheet is conveyed while being nipped between the heating roller and the pressurizing roller and a toner image formed on the sheet is fixed to the sheet.

The fixing device, however, has a defect in that it is difficult to accurately detect the temperature because the part of the outer periphery of the heating roller of which temperature is detected by the thermistor is far from the region (heating region) which is inductively heated by the coil. In particular, failure in the motor might cause the heating roller to stop rotating and to undergo an abnormal local temperature increase, which could not be detected accurately in the above example and might entail a danger of firing.

In such an external coil type in which a coil is placed outside a heating roller as described above, it is often impossible to provide a temperature sensor inside the heating roller because thermal insulating material such as sponge rubber is provided inside the roller. In an internal coil type in which a coil is placed inside a heating roller, it is possible to provide a temperature sensor outside the heating roller so as to face a heating region, however, the placement of major elements inside and outside the heating roller results in increase in scale and cost of the device.

SUMMARY OF THE INVENTION

Therefore, an object of the present invention is to provide an induction heating device and an induction heating fixing device which are capable of accurately detecting temperature of heating region of an object to be heated, at low cost, and capable of increasing stability and safety in control of the temperature.

Another object of the invention is to provide an image forming apparatus having such an induction heating fixing device.

In order to achieve the object, the present invention provides an induction heating device for inductively heating an object to be heated which is formed of conductive material, comprising:

a holder; and a coil for inductively heating the object, the coil being composed of a plurality of turns of conductor forming a layer which is supported by the holder and is positioned along the object, wherein a gap is formed between conductor sections of the coil through which electric currents respectively flow in the same direction, the gap being used for detecting temperature of the object.

Herein, "conductor section" refers to a part of the "conductor" that forms the coil.

In the induction heating device of the invention, the layer of conductor that forms the coil is positioned so as to extend along the object. In an operation, a high-frequency current is passed through the coil, and the object is heated by an induced current (eddy current) caused by the current passage. In the induction heating device, a gap is formed between conductor sections of the coil through which electric currents respectively flow in the same direction, the gap being used for detecting temperature of the object. Therefore a temperature sensor can be provided in the gap so as to face the object, for example. Alternatively, a temperature sensor of infrared type may be provided in a position farther than the coil from the object so that temperature of part of the object corresponding to the gap can be detected with use of the gap as a path for the detection. In those configurations, the part of which the temperature is detected by the temperature sensor is positioned within the region (heating region) that is inductively heated by the coil, and therefore the temperature can be detected accurately. The temperature of the object is controlled to a predetermined temperature on basis of detection signal from the temperature sensor. As a result, stability and safety in temperature control for the object can be improved.

The gap is provided between the conductor sections that form the coil, so that the coil is cooled by passage of air through the gap. Accordingly, heat generating efficiency can be kept high.

The gap in the coil is formed simply by a change in winding of the coil. Besides, the coil and the temperature sensors are positioned on the same side (all outside or all inside) of the object, and therefore the device is not required to have a large scale. As a result, the induction heating device can be configured at low cost.

The object may contain material other than conductive material. The coil may be in the form of a plurality of layers stacked in a direction perpendicular to layer direction, which are composed of a plurality of turns of conductor respectively. The "layer direction" refers to directions along the layer as a whole. In this configuration, the "gap" between conductor sections means a gap along the layer direction.

In an embodiment of the induction heating device, the holder comprises a core made of magnetic material.

In the embodiment of the induction heating device, magnetic flux produced by the coil is guided to the object, through the magnetic material that forms the core. Thus heat generating efficiency is improved. As a result, the induction heating device can be configured compactly and miniaturized.

In an embodiment of the induction heating device, a temperature sensor is provided in the gap so as to face the object.

In the embodiment of the induction heating device, a temperature sensor is provided in the gap so as to face the object. Thus the part of which temperature is detected by the temperature sensor is positioned within the region (heating region) that is inductively heated by the coil, and therefore the temperature can be detected accurately. As a result, stability and safety in temperature control for the object can be improved.

Preferably, the temperature sensor is a thermosensitive switch (thermostat). The thermosensitive switch performs on-off control action with use of thermal energy emitted by an object to be detected, and a structure of a temperature controlling circuit for controlling the temperature of the object can be simplified by use of the thermosensitive switch.

An embodiment of the induction heating device is characterized in that a temperature sensor of infrared type is provided in a position farther than the coil from the object so that temperature of part of the object corresponding to the gap can be detected with use of the gap as a path for the detection.

More particularly, the embodiment of the induction heating device is an induction heating device for inductively heating the object which is formed of conductive material, comprising:

a holder; and the coil for inductively heating the object, the coil being composed of a plurality of turns of conductor forming a layer which is supported by the holder and is positioned along the object, wherein a gap is formed between conductor sections of the coil through which electric currents respectively flow in the same direction, and the temperature sensor of infrared type is provided in the position farther than the coil from the object so that temperature of part of the object corresponding to the gap can be detected with use of the gap as the path for the detection.

In the embodiment of the induction heating device, similarly, the part of which temperature is detected by the temperature sensor is positioned within the region (heating region) that is inductively heated by the coil, and therefore the temperature can be detected accurately. As a result, stability and safety in temperature control for the object can be improved.

In an embodiment of the induction heating device, the object consists of a body of rotation, and the holder and the coil are positioned outside the body of rotation.

Herein, "body of rotation" refers to a solid formed by rotating a two-dimensional figure about an axis.

In the embodiment of the induction heating device, the holder and the coil are positioned outside the body of rotation that forms the object, and temperature of outer surface of the body of rotation is detected from outside of the body of rotation through the gap of the coil. Such a configuration is useful for an object inside which heat insulating material such as sponge rubber is provided and inside which no space exists for provision of a temperature sensor.

In an embodiment of the induction heating device, the object consists of a hollow body of rotation, and the holder and the coil are positioned in hollow space in the hollow body of rotation.

In the embodiment of the induction heating device, the holder and the coil are positioned in hollow space in the hollow body of rotation that forms the object, and temperature of inner surface of the hollow body of rotation is detected from inside of the body of rotation through the gap of the coil. In the embodiment, it is unnecessary to provide the holder and the coil outside the object and therefore the induction heating device can be configured compactly.

In another aspect, the present invention provides an induction heating fixing device of induction heating type for fixing a toner image to a sheet while conveying the sheet, comprising:

a fixing member formed of conductive material;

a pressurizing member for temporarily pinching the sheet being conveyed, between the pressurizing member and the fixing member, the pressurizing member being provided in pressure contact with the fixing member;

a holder; and a first coil for inductively heating the fixing member, the coil being composed of a plurality of turns of conductor forming a layer which is supported by the holder and is positioned along the fixing member, wherein a gap is formed between conductor sections of the coil which extend in a direction parallel to width direction of the sheet being conveyed through pinching part between the fixing member and the pressurizing member and through which electric currents respectively flow in the same direction, the gap being used for detecting temperature of the fixing member.

Herein, "width direction of the sheet" refer to a direction substantially perpendicular to a direction in which the sheet is conveyed, and "conductor section" refers to a part of the "conductor" that forms the coil.

In an operation of the induction heating fixing device of the invention, a high-frequency current is passed through the coil, and the fixing member is heated by an induced current (eddy current) caused by the current passage. Then the sheet is conveyed through the pinching part between the fixing member and the pressurizing member, and a toner image formed on the sheet is thereby fixed to the sheet. In the induction heating fixing device, a gap is formed between conductor sections of the coil which extend in a direction parallel to width direction of the sheet being conveyed through pinching part between the fixing member and the pressurizing member and through which electric currents respectively flow in the same direction, the gap being used for detecting temperature of the fixing member. Therefore, a temperature sensor can be provided in the gap so as to face the fixing member, for example. Alternatively, a temperature sensor of infrared type may be provided in a position farther than the coil from the fixing member so that temperature of part of the fixing member corresponding to the gap can be detected with use of the gap as a path for the detection. In those configurations, the part of which temperature is detected by the temperature sensor is positioned within the region (heating region) that is inductively heated by the coil, and therefore the temperature can be detected accurately. The temperature of the fixing member is controlled to a predetermined temperature on basis of detection signal from the temperature sensor. As a result, stability and safety in temperature control for the fixing member can be improved.

The gap is provided between the conductor sections that form the coil, so that the coil is cooled by passage of air through the gap. Accordingly, a heat generating efficiency can be kept high.

The gap in the coil is formed simply by a change in winding of the coil. Besides, the coil and the temperature sensors are positioned on the same side (all outside or all inside) of the fixing member, and therefore the device is not required to have a large scale. As a result, the induction heating fixing device can be configured at low cost.

The fixing member may contain material other than conductive material. The coil may be in the form of a plurality of layers stacked in a direction perpendicular to layer direction, which are composed of a plurality of turns of conductor respectively. The "layer direction" refers to directions along the layer as a whole. In this configuration, the "gap" between conductor sections means a gap along the layer direction.

In an embodiment of the induction heating fixing device, the holder comprises a core made of magnetic material.

In the embodiment the induction heating fixing device, magnetic flux produced by the coil is guided to the fixing member through the magnetic material that forms the core. Thus heat generating efficiency is improved. As a result, the induction heating fixing device can be configured compactly and miniaturized.

In an embodiment of the induction heating fixing device, a temperature sensor is provided in the gap so as to face the fixing member.

In the embodiment of the induction heating fixing device, a temperature sensor is provided in the gap so as to face the fixing member. Thus the part of which temperature is detected by the temperature sensor is positioned within the region (heating region) that is inductively heated by the coil, and therefore the temperature can be detected accurately. As a result, stability and safety in temperature control for the fixing member can be improved.

Preferably, the temperature sensor is a thermosensitive switch (thermostat). The thermosensitive switch performs on-off control action with use of thermal energy emitted by an object to be detected, i.e., the fixing member. Therefore structure of temperature controlling circuit for controlling the temperature of the fixing member can be simplified by use of the thermosensitive switch.

An embodiment of the induction heating fixing device is characterized in that a temperature sensor of infrared type is provided in a position farther than the coil from the fixing member so that temperature of part of the fixing member corresponding to the gap can be detected with use of the gap as a path for the detection.

More particularly, the embodiment of the induction heating fixing device is an induction heating fixing device for inductively heating a fixing member which is formed of conductive material, comprising:

a holder; and the coil for inductively heating the fixing member, the coil being composed of a plurality of turns of conductor forming a layer which is supported by the holder and is positioned along the fixing member, wherein a gap is formed between conductor sections of the coil through which electric currents respectively flow in the same direction, and the temperature sensor of infrared type is provided in the position farther than the coil from the fixing member so that temperature of part of the fixing member corresponding to the gap can be detected with use of the gap as the path for the detection.

In the embodiment of the induction heating fixing device, similarly, the part of which the temperature is detected by the temperature sensor is positioned within the region (heating region) that is inductively heated by the coil, and therefore the temperature can be detected accurately. As a result, stability and safety in temperature control for the fixing member can be improved.

In an embodiment of the induction heating fixing device, the fixing member consists of a body of rotation, and the holder and the coil are positioned outside the body of rotation.

Herein, "body of rotation" refers to a solid formed by rotating a two-dimensional figure about an axis.

In the embodiment of the induction heating fixing device, the holder and the coil are positioned outside the body of rotation that forms the fixing member, and temperature of outer surface of the body of rotation is detected from outside of the body of rotation through the gap of the coil. Such a configuration is useful for a fixing member inside which heat insulating material such as sponge rubber is provided and inside which no space exists for provision of a temperature sensor.

In an embodiment of the induction heating fixing device, the fixing member consists of a hollow body of rotation, and the holder and the coil are positioned in hollow space in the hollow body of rotation.

In the embodiment of the induction heating fixing device, the holder and the coil are positioned in hollow space in the hollow body of rotation that forms the fixing member, and temperature of inner surface of the hollow body of rotation is detected from inside of the body of rotation through the gap of the coil. In the embodiment, it is unnecessary to provide the holder and the coil outside the fixing member and therefore the induction heating fixing device can be configured compactly.

In an embodiment of the induction heating fixing device, the fixing member consists of a body of rotation that is rotated about a central axis, the holder has a protrusion extending toward the body of rotation and wound in the coil, and the gaps in the coil are provided on upstream side and downstream side of the protrusion of the holder with respect to rotation direction of the fixing member.

Herein, "central axis" refers to the central axis of the body of rotation.

In the embodiment of the induction heating fixing device, the gaps in the coil are provided on upstream side and downstream side of the protrusion of the holder with respect to the rotation direction of the fixing member. Accordingly, distribution of generated heat on the fixing member is symmetrical about a part of the fixing member corresponding to the protrusion of the holder, on upstream side and downstream side of the protrusion with respect to the rotation direction of the fixing member. Therefore temperature of part of the fixing member corresponding to the gap on the downstream side, for example, can be found by provision of a temperature sensor in the gap on the upstream side, for example, and by detection of temperature of part of the fixing member corresponding to the gap. Thus the temperature can be detected more accurately. As a result, stability and safety in temperature control for the fixing member can be improved.

In an embodiment, the induction heating fixing device further comprises a second coil for heating a second region of the fixing member wherein the second region is different from a first region of the fixing member heated by the first coil with respect to the width direction of the sheet.

Herein, the "second region" is not entirely superimposed on the first region, i.e., the "second region" is partially superimposed on the first region.

Typically, the first region of the fixing member which is heated by the first coil with respect to the width direction of the sheet (which will be referred to as "first heating width") is determined in accordance with a sheet having the largest width that is fed to the device. That is intended for achieving satisfactory fixing over the whole area of the sheet having the largest width. When a sheet having a width smaller than the sheet having the largest width is fed, there is produced a part of the first heating width that does not contribute to heating of the sheet. Then the temperature of the part may become higher than that of the other part that contributes to heating of the sheet, and the temperature of the fixing member may vary with respect to the width direction of the sheet. Therefore, the embodiment of the induction heating fixing device has a second coil for heating a second region of the fixing member wherein the second region is different from a first region of the fixing member heated by the first coil with respect to the width direction of the sheet, as described above. The second region of the fixing member which is heated by the second coil (which will be referred to as "second heating width") may be determined in accordance with sheets that are fed to the device. For example, the second region is determined in accordance with a sheet smaller in width than the sheet having the largest width that is fed to the device. With such a setting, the whole second heating width can be made to contribute to heating of the sheet. Thus the temperature of the fixing member becomes uniform with respect to the width direction of the sheet. Consequently, stability and safety in the temperature control for the fixing member can further be improved.

In another aspect, the present invention provides an image forming apparatus comprising an image forming unit for forming a toner image and an induction heating fixing device of induction heating type for fixing to a sheet the toner image formed by the image forming unit while conveying the sheet, comprising:

a fixing member formed of conductive material;

a pressurizing member for temporarily pinching the sheet being conveyed between the pressurizing member and the fixing member, the pressurizing member being provided in pressure contact with the fixing member;

a holder; and a coil for inductively heating the fixing member, the coil being composed of a plurality of turns of conductor forming a layer which is supported by the holder and is positioned along the fixing member, wherein a gap is formed between conductor sections of the coil which extend in a direction parallel to width direction of the sheet being conveyed through pinching part between the fixing member and the pressurizing member and through which electric currents respectively flow in the same direction, the gap being used for detecting temperature of the fixing member.

The image forming unit may form the toner image directly on the sheet or may form the toner image temporarily on a transferring body and may thereafter transfer the toner image onto the sheet.

In an operation of the image forming apparatus of the invention, a high-frequency current is passed through the coil of the induction heating fixing device, and the fixing member is heated by an induced current (eddy current) caused by the current passage. Then a toner image is formed by the image forming unit, a sheet is conveyed through the pinching part between the fixing member and the pressurizing member, and the toner image formed by the image forming unit is thereby fixed to the sheet. In the image forming apparatus, a gap is formed between conductor sections of the coil which extend in a direction parallel to width direction of the sheet being conveyed through pinching part between the fixing member and the pressurizing member and through which electric currents respectively flow in the same direction, the gap being used for detecting temperature of the fixing member. Therefore, a temperature sensor can be provided in the gap so as to face the fixing member, for example. Alternatively, a temperature sensor of infrared type may be provided in a position farther than the coil from the fixing member so that temperature of part of the fixing member corresponding to the gap can be detected with use of the gap as a path for the detection. In those configurations, the part of which the temperature is detected by the temperature sensor is positioned within the region (heating region) that is inductively heated by the coil, and therefore the temperature can be detected accurately. The temperature of the fixing member is controlled to a predetermined temperature on basis of detection signal from the temperature sensor. As a result, stability and safety in temperature control for the fixing member can be improved.

The gap is provided between the conductor sections that form the coil, so that the coil is cooled by passage of air through the gap. Accordingly, heat generating efficiency can be kept high.

The gap in the coil is formed simply by a change in winding of the coil. Besides, the coil and the temperature sensor are positioned on the same side (all outside or all inside) of the fixing member, and therefore the device is not required to have a large scale. As a result, the image forming apparatus can be configured at low cost.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
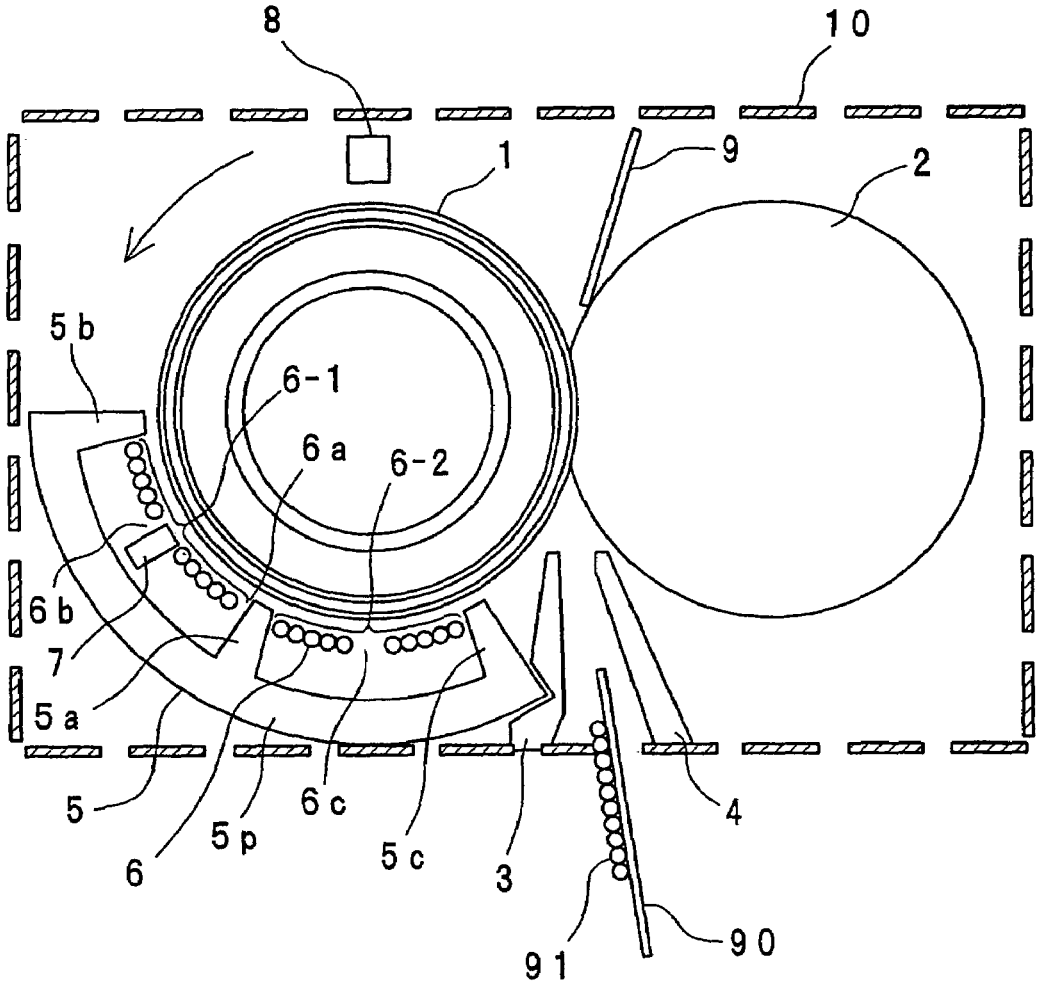
FIG. 1 is a diagram showing a schematic sectional configuration of a fixer for color laser printer as one embodiment of the invention.

Hereinbelow, the present invention will be described in detail with reference to embodiments shown in the drawings.

FIG. 1 shows a sectional configuration of a fixer for color laser printer as one embodiment of an induction heating fixing device having an induction heating device of the invention.

The fixer has in a casing 10 a cylindrical fixing roller 1 as an object to be heated or a fixing member, a cylindrical pressurizing roller 2 as a pressurizing member, a ferrite core 5 as a holder, a layer-like coil 6 that is positioned so as to extend along outer periphery of the fixing roller 1, a first temperature sensor 7 composed of a thermostat, a second temperature sensor 8 of infrared type, and guides 3, 4, and 9 for guiding a paper form 90 as a sheet.

Figure 2A:
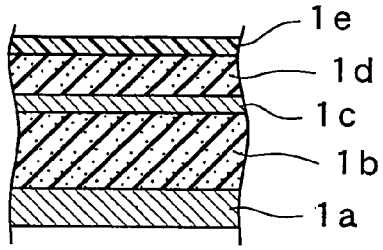
FIG. 2A is a diagram showing a sectional configuration of a part of fixing roller that is a component of the fixer of FIG. 1.
Figure 2B:
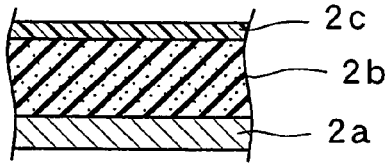
FIG. 2B is a diagram showing a sectional configuration of a part of pressurizing roller that is a component of the fixer of FIG. 1.

As shown in FIG. 2A, the fixing roller 1 is composed of a 1-mm-thick core metal 1*a* made of iron on which a 5-mm-thick Si (silicon) sponge rubber layer 1*b*, a 50-μm-thick alloy layer 1*c* composed of Ni (nickel) and Cr (chromium), a 1-mm-thick Si rubber layer 1*d*, and a 20-μm-thick surface layer 1*e* composed of PFA (copolymer of tetrafluoroethylene and perfluoroalkyl vinylether) have been provided. As shown in FIG. 2B, the pressurizing roller 2 is composed of a core metal 2*a* made of iron on which a 5-mm-thick Si foam rubber layer 2*b* and a 30-μm-thick PFA surface layer 2*c* have been provided.

The fixing roller 1 in FIG. 1 is configured so as to be rotated counterclockwise about a central axis thereof by a motor not shown. The pressurizing roller 2 on right side of the fixing roller 1 is biased against the fixing roller 1 by a spring not shown so that a nipping part as a pinching part is formed between the roller 2 and the fixing roller 1 with deformation of the rubber layers. The pressurizing roller 2 is configured so as to be driven by the fixing roller 1. The unfixed paper form 90 having toner 91 thereon is conveyed to the nipping part from downside so as to be passed between the guides 3 and 4 and, after a fixing process, the form 90 is guided by the guide 9 so as to be ejected upward.

The ferrite core 5 is composed of magnetic material and is positioned outside and below the fixing roller 1 so as to extend along and face the outer periphery of the fixing roller 1. The ferrite core 5 has a section generally shaped like a letter E as a whole and extends along axial direction of the fixing roller 1. Specifically, the ferrite core 5 has a main body 5*p* having a cross section shaped like a circular arc with the same curvature that the outer periphery of the fixing roller 1 has, and three protrusions extending from the main body 5*p* toward the fixing roller 1, i.e., a center protrusion 5*a* and end protrusions 5*b* and 5*c*.

Figure 3:
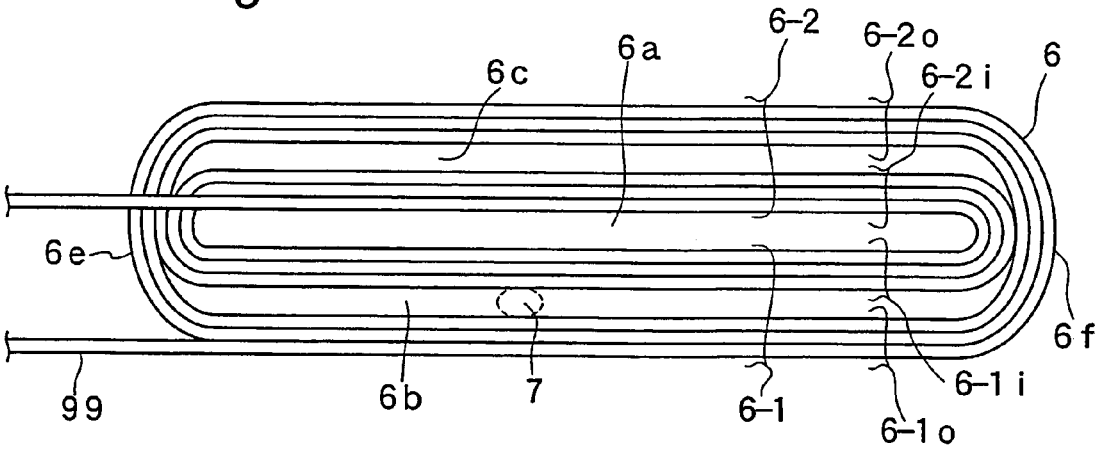
FIG. 3 is a diagram showing a plane layout of a coil that is a component of the fixer of FIG. 1.

As shown in FIG. 3, the coil 6 is formed of a plurality of turns of conductor 99 shaped like ellipses in a plane layout in general view. A piece of conductor 99 is made of a publicly-known strand with a diameter on the order of several millimeters that has been formed of a bunch of about one hundred and tens of pieces of wire (copper wire having a diameter on the order of 0.18 to 0.20 mm and having insulating enamel coating) for increase in current-carrying efficiency.

Specifically, the coil 6 includes an outward conductor section 6-1 and a return conductor section 6-2 both of which extend in longitudinal direction (in lateral direction in FIG. 3) and circular-arc curved conductor sections 6*f* and 6*e* which link the outward and return conductor sections to each other. Between the outward conductor section 6-1 and the return conductor section 6-2 exists a center gap 6*a* on the order of several millimeters. The coil 6 is wound tight, basically, but a gap 6*b* on the order of several millimeters is provided between an outer conductor section 6-1*o* and an inner conductor section 6-1*i* in the outward conductor section 6-1 through which electric currents respectively flow in the same direction. In the same manner as the gap 6*b*, a gap 6*c* on the order of several millimeters is provided between an outer conductor section 6-2*o* and an inner conductor section 6-2*i* in the return conductor section 6-2 through which electric currents respectively flow in the same direction. In this example, the gaps 6*b* and 6*c* as well as the center gap 6*a* extend uniformly in the longitudinal direction from the curved conductor section 6*f* to the curved conductor section 6*e* at both ends thereof.

The longitudinal direction of the coil 6 correspond to a direction parallel to the central axis of the fixing roller 1 in FIG. 1, in other words, correspond to width direction of the paper form 90 that are substantially perpendicular to the direction in which the paper form 90 is conveyed in the nipping part. A size of the fixing roller 1 in the axial direction and a size of the coil 6 in the longitudinal direction are set at values of 297 mm plus small margins so that a paper form having the largest width that is fed to the device (a paper form of "A3 size" defined by the Japanese Industrial Standards, in this example) can be dealt with.

As shown in FIG. 1, the coil 6 is mounted on the ferrite core 5 with adhesive such as glue in such a manner that the center gap 6*a* of the coil 6 is fit on the center protrusion 5*a* of the ferrite core 5 and that the coil 6 as a whole is surrounded and enclosed by the end protrusions 5*b* and 5*c* of the ferrite core 5. After the mounting on the ferrite core 5, the layer that the coil 6 forms has the same curvature as that of the outer periphery of the fixing roller 1, so as to extend along the outer periphery of the fixing roller 1.

The first temperature sensor 7 composed of a thermostat is positioned in the gap 6*b* of the coil 6 so as to face the fixing roller 1. In this example, the first temperature sensor 7 is placed generally at longitudinal center (a position shown by a broken line in FIG. 3) of the gap 6*b*.

The ferrite core 5, the coil 6, and the first temperature sensor 7 form a coil unit for induction heating as the induction heating device.

Upon passage of a current through the coil 6 in such an arrangement, most of a magnetic field produced by the coil 6 is guided by the ferrite core 5 to pass through the Ni alloy layer 1*c* of the fixing roller 1, eddy currents are produced there, and heat is generated in a region of the outer periphery of the fixing roller 1 that faces the coil 6. Thus most of the magnetic field produced by the exciting coil 6 is guided to the fixing roller 1 through the ferrite core 5 that is magnetic material, and therefore heat generating efficiency is increased. As a result, this fixer can be made compact and can be miniaturized.

Figure 4A:
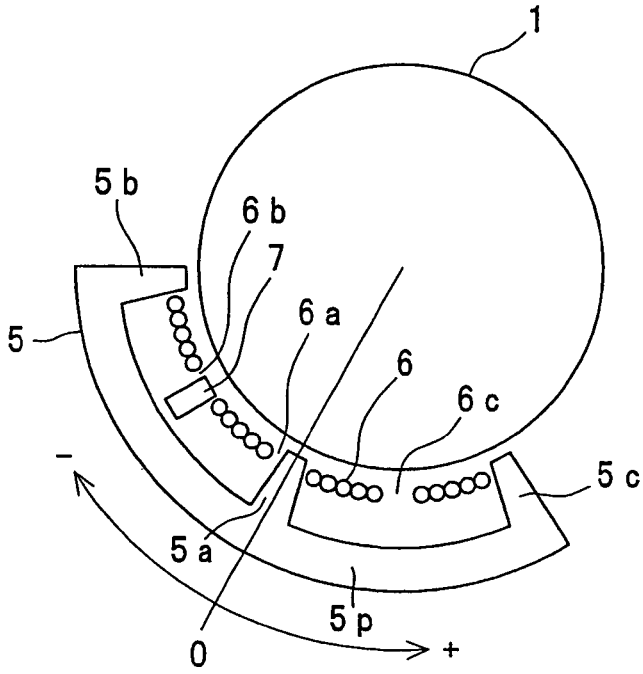
FIG. 4A is a diagram illustrating angular coordinates in the fixing roller.
Figure 4B:
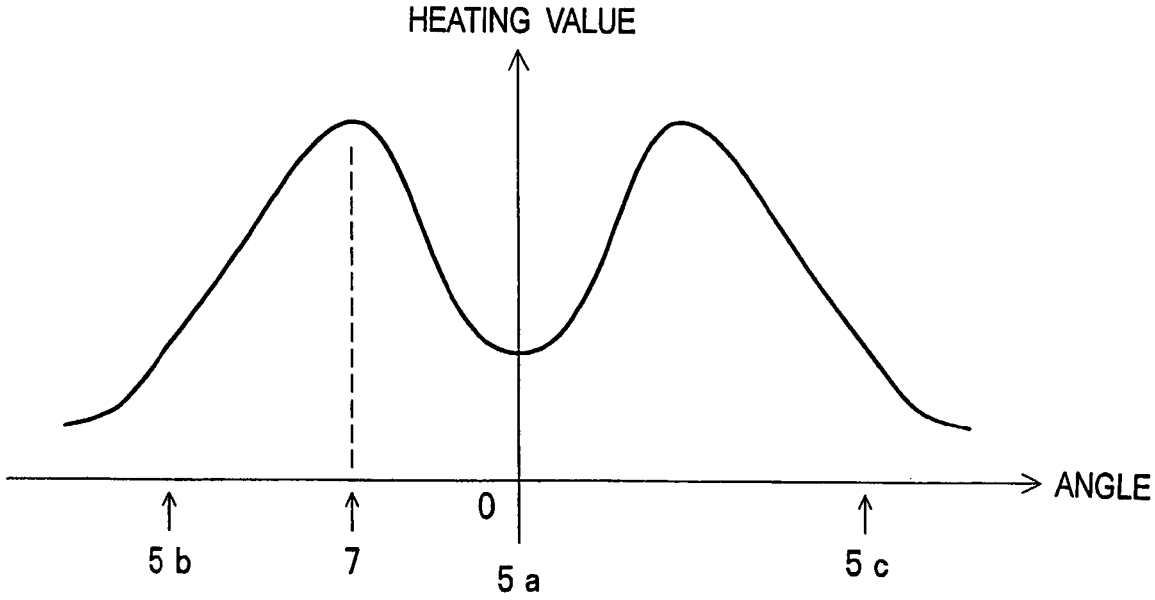
FIG. 4B is a diagram showing a distribution of generated heat with respect to angle direction in the fixing roller.

As shown in FIG. 4A, a graph is drawn with a condition that a line extending from the center of the fixing roller 1 through the center (the center protrusion 5*a*) of the ferrite core 5 is used as an origin O of an angular coordinate and that heating values are plotted as ordinates and, as shown in FIG. 4B, a symmetrically distribution of generated heat is thereby obtained that has peaks on both sides of the origin O, i.e., on an upstream side and a downstream side with respect to the rotation direction of the fixing roller 1. Most of the region (the heating region) that is inductively heated by the coil 6 is included in an area in which the ferrite core 5 faces.

Angle positions of the gaps 6*b* and 6*c* of the coil 6 are made to correspond to positions of peaks in the distribution of generated heat. That is, the thermostat 7 provided in the gap 6*b* is capable of detecting temperature of a peak of the distribution of generated heat. Since the distribution of generated heat is symmetrical on both sides of the origin O, temperature of part corresponding to the gap 6*c* on the downstream side can be found by providing the temperature sensor in the gap 6*b* on the upstream side, as shown in this example, and detecting the temperature of the part corresponding to the gap 6*b*.

As shown in FIG. 1, on the other hand, the second temperature sensor 8 faces a part of the outer periphery of the fixing roller 1 that is far from the heating region. Accordingly, the second temperature sensor 8 detects an averaged temperature that has been relaxed by heat transfer, when a heating region of the fixing roller 1 at a certain time comes to the position facing the sensor 8 while rotating.

Figure 5A:
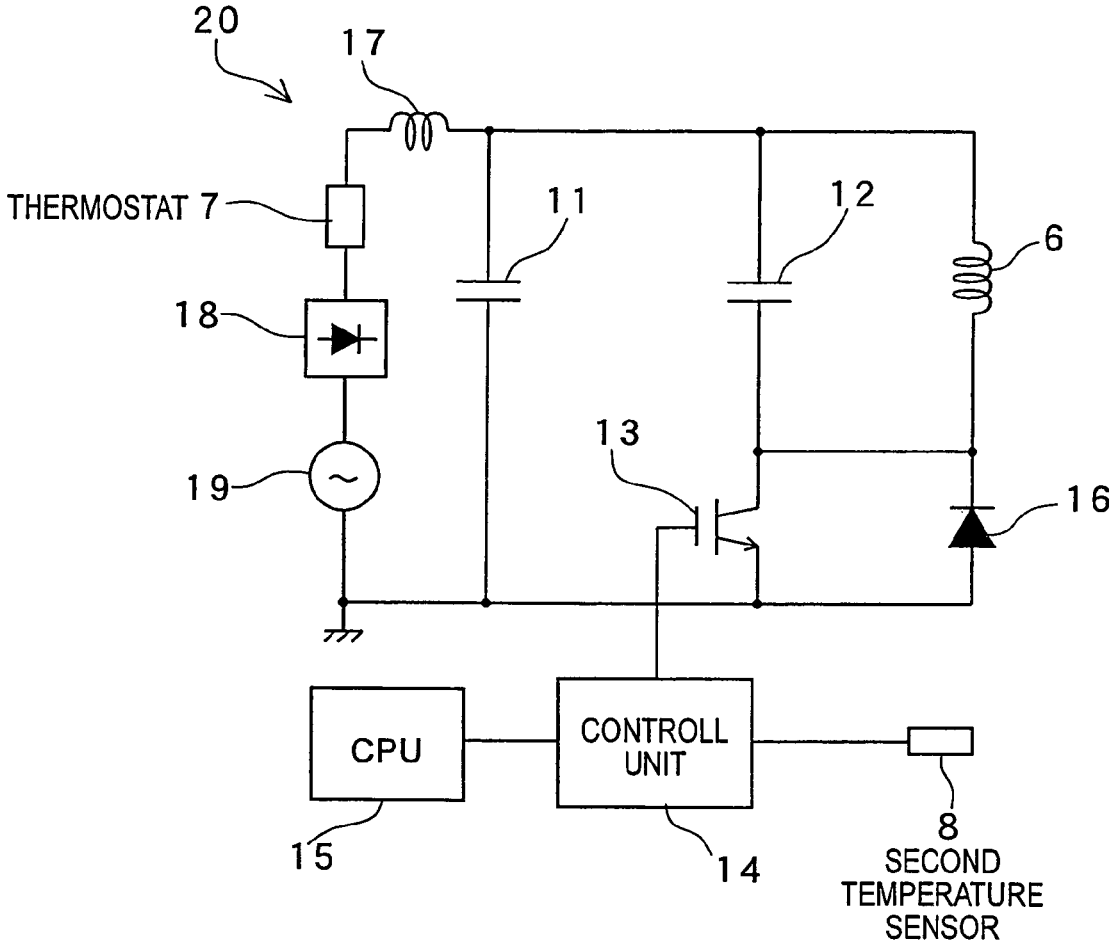
FIG. 5A is a diagram showing a configuration of a temperature controlling circuit for the fixer.

FIG. 5A shows a configuration of a temperature controlling circuit 20 for passing a current through the coil 6 while controlling the temperature of the fixing roller 1. The temperature controlling circuit 20 has an AC (alternating current) power supply 19, a diode 18 for rectification, a thermostat (a switch unit thereof) 7 inserted in series with respect to the AC power supply 19, a smoothing coil 17 and a smoothing capacitor 11, a main capacitor 12 that forms a single LC oscillator circuit in combination with the coil 6, an IGBT (Insulated Gate Bipolar Transistor) 13 for turning on and off the LC oscillator circuit, a diode 16 for extinguishing residual electric charge when the circuit shifts to off state, and a control unit 14 for turning on and off the IGBT 13.

Figure 5B:
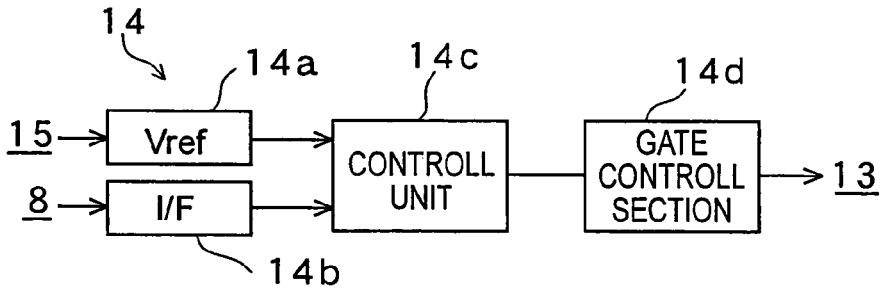
FIG. 5B is a diagram showing a configuration of a control unit that is a component of the temperature controlling circuit.

On basis of signal representing an operation mode from a CPU (Central Processing Unit) 15 for performing control over a whole printer (signal on a target temperature of the fixing roller 1 in printing mode, standby mode or the like) and signal representing a detected temperature from the second temperature sensor 8, the control unit 14 performs ON/OFF control over the IGBT 13 so as to approach the detected temperature to the target temperature. As shown in FIG. 5B, specifically, the control unit 14 is composed of a reference voltage producing section 14*a* for producing a reference voltage Vref corresponding to an operation mode (a target temperature), an interface (I/F) section 14*b* for converting an output of the second temperature sensor 8 into a voltage that can be compared with the reference voltage Vref, a comparing section 14*c* for detecting a difference between the reference voltage Vref from the reference voltage producing section 14*a* and the voltage from the interface section 14*b*, and a gate control section 14*d* for controlling a gate voltage of the IGBT 13 in accordance with the difference.

In a printing operation, the temperature of the fixing roller 1 is controlled to be kept at a target temperature according to a printing mode by the temperature controlling circuit 20 including the control unit 14. Then a paper form 90 is conveyed through the nipping part between the fixing roller 1 and the pressurizing roller 2, and a toner image 91 formed on the paper form 90 is thereby fixed to the paper form 90.

On condition that the rotation of the fixing roller 1 is stopped or retarded by failure in the motor or the like, in particular, the heating region of the fixing roller 1 may extraordinarily rise in temperature. In the fixer, the thermostat 7 as the first temperature sensor provided in the gap 6*b* of the coil described above detects the temperature of the peak of the distribution of generated heat. Therefore, the peak temperature of the distribution of generated heat can be detected accurately. If the peak temperature of the distribution of generated heat exceeds a temperature specified in a predetermined safety standard, the thermostat 7 is turned off and the passage of the current through the coil 6 is thereby interrupted. As a result, stability and safety in the temperature control for the fixing roller 1 are improved.

The gaps 6*b* and 6*c* are provided between the conductor sections forming the coil 6, so that the coil 6 is cooled by passage of air through the gaps 6*b* and 6*c*. Accordingly, copper loss is restrained from increasing and the heat generating efficiency can be kept high.

The gaps 6*b* and 6*c* between the conductor sections that form the coil 6 are formed simply by the change in winding of the coil. Besides, the coil 6 and the temperature sensors 7 and 8 are positioned on the same side (outside, in this example) of the fixing roller 1, and therefore the device is not required to have a large scale. As a result, the fixer can be configured at low cost.

Figure 6A:
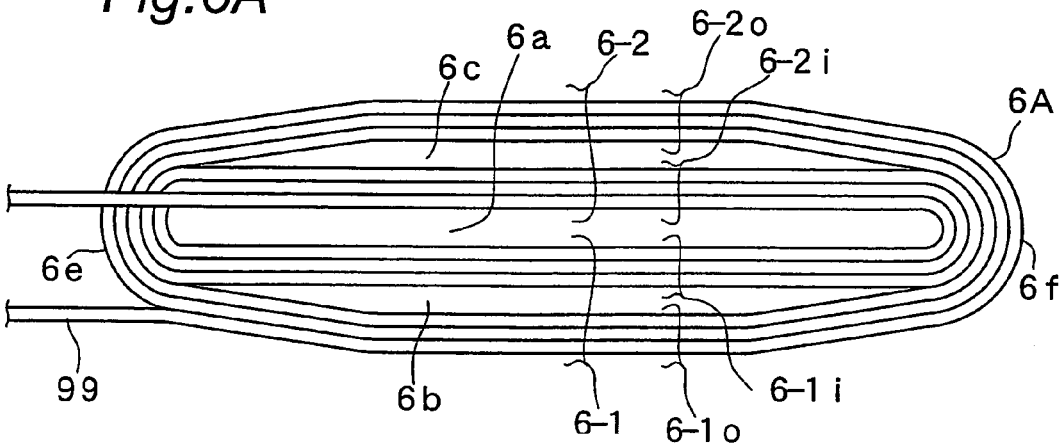
FIG. 6A is a diagram showing a modification of the coil of FIG. 3.
Figure 6B:
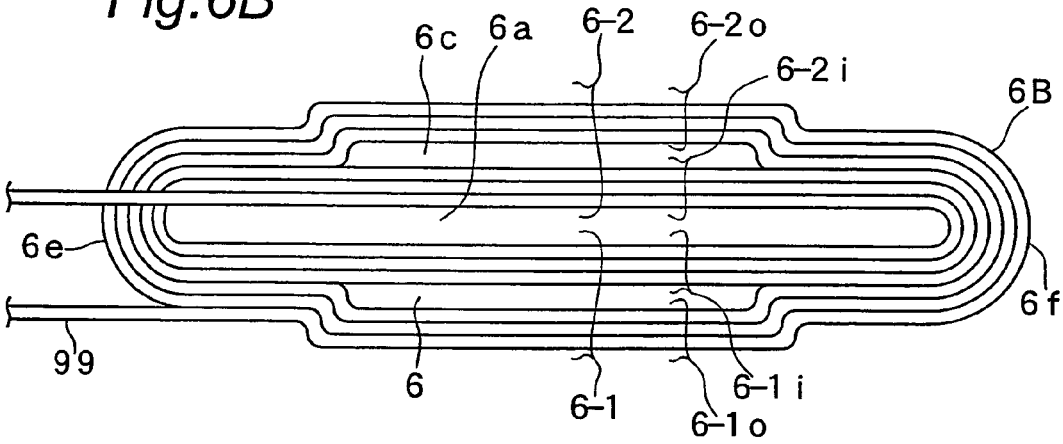
FIG. 6B is a diagram showing another modification of the coil of FIG. 3.
Figure 6C:
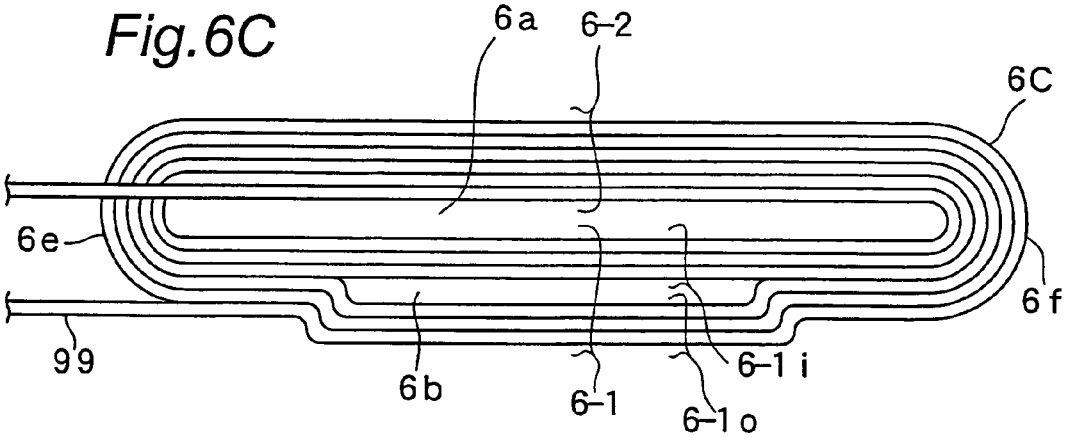
FIG. 6C is a diagram showing still another modification of the coil of FIG. 3.

FIGS. 6A, 6B, and 6C show modifications of the coil 6 (that are designated by reference characters 6A, 6B, and 6C). The gaps 6*b* and 6*c* of the coil 6 in the example shown in FIG. 3 extend symmetrically about the center gap 6*a* and uniformly in the longitudinal direction, however, the configuration of the gaps is not limited thereto.

For example, sizes of gaps 6*b* and 6*c* may vary with longitudinal positions as in the coils 6A and 6B shown in FIGS. 6A and 6B. In the coil 6A, the closer to curved sections 6*e* and 6*f* the gaps 6*b* and 6*c* in vicinity of the curved sections 6*e* and 6*f* at both ends are, the narrower the gaps 6*b* and 6*c* are. In the coil 6B, the gaps 6*b* and 6*c* disappear and the winding becomes tight in vicinity of curved sections 6*e* and 6*f* at both ends.

As in the coil 6C shown in FIG. 6C, a gap 6*b* may be provided in only one of an outward conductor section 6-1 and a return conductor section 6-2. In this example, the gap 6*b* may be provided only in the outward conductor section 6-1 and a gap may be omitted in the other return conductor section 6-2. By the provision of the gap in only one of the outward conductor section 6-1 and the return conductor section 6-2, an area of layer which the coil forms can be reduced and the device can be miniaturized.

The gaps do not have to exist in the center of a length of the coil and a large number of gaps may be provided.

Figure 7:
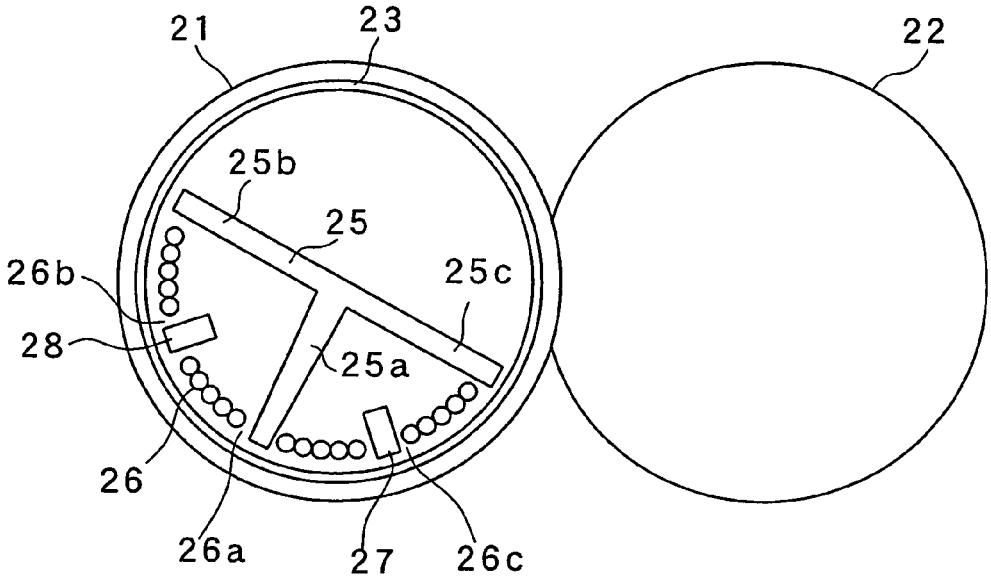
FIG. 7 is a diagram showing a sectional configuration of a fixer of another embodiment of the invention.

FIG. 7 shows a sectional configuration of a fixer in accordance with another embodiment. In the embodiment described above, the coil unit for induction heating is provided outside the fixing roller. In the present embodiment, however, the coil unit is provided inside a fixing roller.

Figure 8:
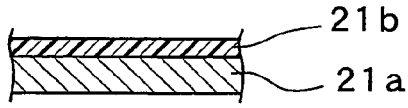
FIG. 8 is a diagram showing a sectional configuration of a part of fixing roller that is a component of the fixer of FIG. 7.

Specifically, the fixer has a cylindrical fixing roller 21 as an object to be heated or a fixing member and a cylindrical pressurizing roller 22 as a pressurizing member with which the fixing roller 21 is in pressure contact. As is the case with the embodiment described above, a nipping part as a pinching part is formed between the fixing roller 21 and the pressurizing roller 22. As shown in FIG. 8, the fixing roller 21 is composed of a 0.4-mm-thick core metal 21*a* made of iron and a 20-μm-thick PTFE (polytetrafluoroethylene) layer 21*b*.

As shown in FIG. 7, a cylindrical holder 23 extending along inner periphery of the fixing roller 21 is provided in a cavity inside the fixing roller 21, with a little space between. Though the fixing roller 21 is rotated counterclockwise about a central axis thereof, the holder 23 is supported by a supporting member not shown so as to be stationary.

In the holder 23 are installed a ferrite core 25 having a T-shaped cross section and a layer-like coil 26 provided along the inner periphery of the fixing roller 21.

The ferrite core 25 has a center protrusion 25*a* extending toward the fixing roller 21 and two end protrusions 25*b* and 25*c* extending toward the fixing roller 21 in directions opposite to each other.

The coil 26 is identical with the coil 6 shown in FIG. 3, and has a center gap 26*a* and gaps 26*b*, 26*c* positioned symmetrically about the center gap 26*a*. The gaps 26*b* and 26*c* are provided between conductor sections through which electric currents respectively flow in the same direction.

In this example, a first temperature sensor 27 composed of a thermostat is positioned in one gap 26*b* and a second temperature sensor 28 is positioned in the other gap 26*c*. Thus temperature of inner surface of the fixing roller 21 is detected from inside of the fixing roller 21 through the gaps 26*b* and 26*c* of the coil 26.

In a printing operation, the temperature controlling circuit 20 shown in FIG. 5A passes electric current through the coil 26 while controlling the temperature of the fixing roller 21. The temperature of the fixing roller 21 is thereby controlled to a target temperature according to a printing mode. Then a paper form 90 is conveyed through the nipping part between the fixing roller 21 and the pressurizing roller 22, and a toner image 91 formed on the paper form 90 is thereby fixed to the paper form 90.

The embodiment improves stability and safety in the temperature control for the fixing roller 21, as is the case with the embodiment described above. Besides, the fixer can compactly be configured because it is unnecessary to provide a holder, a coil and the like outside the fixing roller 21.

Figure 10:
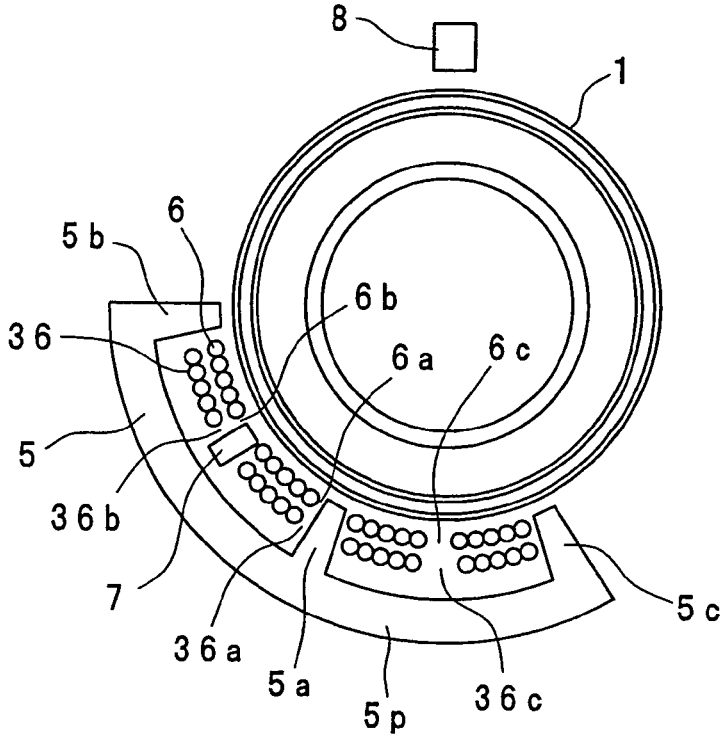
FIG. 10 is a diagram illustrating a fixer of another embodiment of the invention, the fixer having the second coil of FIG. 9.

FIG. 10 shows a sectional configuration of a fixer in accordance with still another embodiment. In the embodiment, a second coil 36 that is wound so as to form a layer is interposed between the ferrite core 5 and the coil 6 (that will be referred to as "first coil," hereinbelow) in the configuration of FIG. 1.

Figure 9:
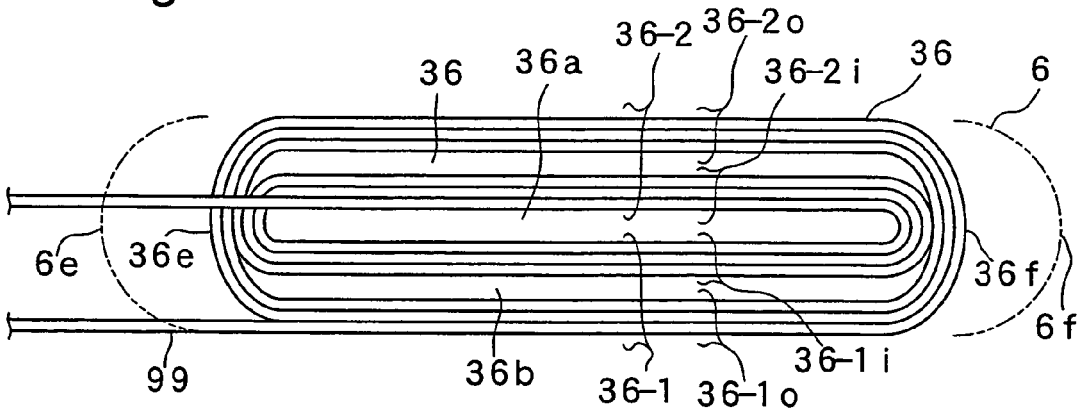
FIG. 9 is a diagram showing a plane layout of a second coil.

As shown in FIG. 9, longitudinal size of the second coil 36 is set so as to be smaller than longitudinal size (a size between the sections 6*e* and 6*f* shown by broken lines) of the first coil 6. As describe above, the longitudinal size of the first coil 6 is set at a value of 297 mm (a width of A3 size) plus a small margin which value corresponds to a paper form having the largest width that is fed to the device (a paper form of A3 size defined by the Japanese Industrial Standards, in this example). The longitudinal size of the second coil 36 is set at a value of 257 mm (a width of B4 size) plus a small margin which value corresponds to a paper form of B4 size, for example.

A configuration of the second coil 36 except the longitudinal size is the same as the configuration of the first coil 6. That is, the second coil 36 has a center gap 36*a* and gaps 36*b*, 36*c* positioned symmetrically about the center gap 36*a*. The gaps 36*b* and 36*c* are provided between conductor sections through which electric currents respectively flow in the same direction. On condition that the second coil 36 is stacked on the first coil 6 as shown in FIG. 10, the gaps 36*a*, 36*b*, and 36*c* of the second coil 36 correspond to the gaps 6*a*, 6*b*, and 6*c* of the first coil 6, respectively.

Consequently, a distribution of generated heat provided by the second coil 36 coincides with the distribution of generated heat provided by the first coil 6, according to observation along the outer periphery of the fixing roller 1. That is, the distribution of generated heat is symmetrical and have peaks on the upstream side and the downstream side with respect to the rotation direction of the fixing roller 1.

According to observation in direction along the central axis of the fixing roller 1, i.e., in direction along the width of the paper form 90, the region that is heated by the second coil 36 (which will be referred to as "second heating width") is narrower than the region that is heated by the first coil 6 (which region will be referred to as "first heating width").

A first temperature sensor 7 composed of a thermostat is positioned so as to extend through the gap 6*b* of the first coil 6 and the gap 36*b* of the second coil 36 and so as to face the fixing roller 1. A second temperature sensor 8 faces a part of the outer periphery of the fixing roller 1 that is far from the heating region, as is the case with the embodiment of FIG. 1.

In a printing operation, the temperature controlling circuit 20 shown in FIG. 5A passes electric current through the first coil 6 or through the second coil 36 while controlling the temperature of the fixing roller 1. Specifically, the current is passed through the first coil 6 when a paper form of A3 size having the largest width is fed. When a paper form of B4 size having a width smaller than A3 form has is fed, changeover from the coil 6 to the coil 36 is performed by a switch not shown on basis of signal representing a size of paper form and sent from the CPU 15 in the circuit of FIG. 5A, so that the current is passed through the second coil 36. The temperature of the fixing roller 1 are thereby controlled to a target temperature according to a printing mode. Then the paper form is conveyed through nipping part between the fixing roller 1 and a pressurizing roller 22, and a toner image formed on the paper form is thereby fixed to the paper form.

When a paper form of A3 size having the largest width is fed, in this arrangement, the whole first heating width that is heated by the first coil 6 can be made to contribute to heating of the paper form. When a paper form of B4 size having a width smaller than A3 form has is fed, the whole second heating width that is heated by the second coil 36 can be made to contribute to heating of the paper form. Thus the temperature of the fixing roller 1 becomes uniform along the width of a paper form. Consequently, stability and safety in the temperature control for the fixing roller can further be improved.

In accordance with the embodiment, the peak temperature of the distribution of generated heat is detected with use of the single thermostat 7 that is common on occasion of the current passage through the first coil 6 and on occasion of the current passage through the second coil 36, and therefore the fixer can be configured compactly at low cost. Complication of circuit structure is also avoided.

Figure 11:
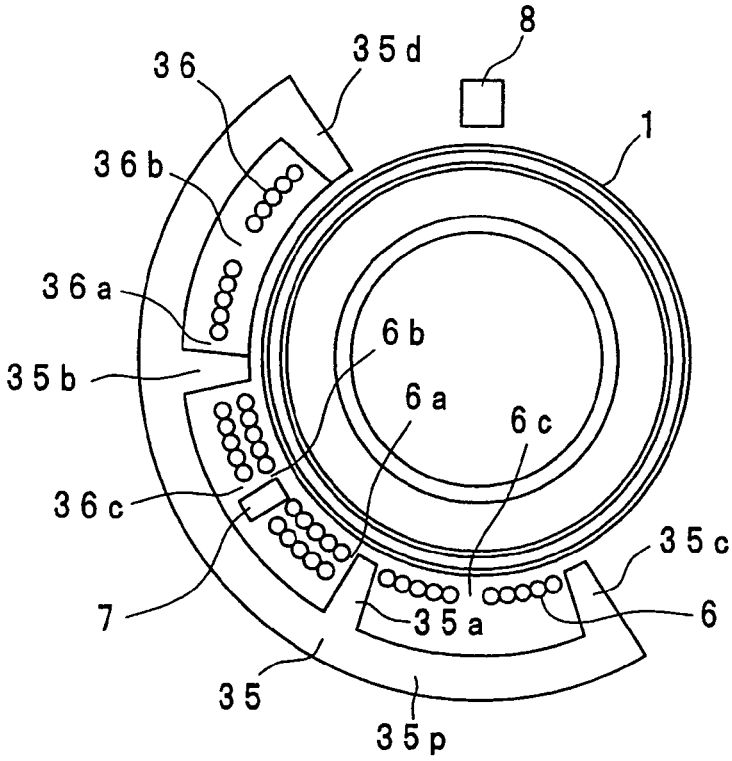
FIG. 11 is a diagram illustrating a fixer of still another embodiment of the invention, the fixer having the second coil of FIG. 9.

FIG. 11 shows a sectional configuration of a fixer in accordance with still another embodiment. In the embodiment, the positions of the first coil 6 and the second coil 36 in the embodiment of FIG. 10 are offset along the outer periphery of the fixing roller 1. In the embodiment of FIG. 10, not only the thermostat 7 but also magnetic paths of the ferrite core 5 are used in common for both the coils 6 and 36. In the present embodiment, however, only the thermostat 7 is used in common and different magnetic paths are used for the coils 6 and 36.

Specifically, the fixer has a ferrite core 35 obtained by enlargement of the ferrite core 5 in FIG. 10 along the outer periphery of the fixing roller 1. The ferrite core 35 has a main body 35*p* having a cross section shaped like a circular arc with the same curvature that the outer periphery of the fixing roller 1 has, and four protrusions extending from the main body 35*p* toward the fixing roller 1, i.e., inner protrusions 35*a*, 35*b* and end protrusions 35*c*, 35*d*.

The first coil 6 is mounted on the ferrite core 35 in such a manner that a center gap 6*a* of the coil 6 is fit on the inner protrusion 35*a* of the ferrite core 35 and that the coil 6 as a whole is surrounded by and enclosed between the inner protrusion 35*b* and the end protrusion 35*c* of the ferrite core 35. The second coil 36 is mounted on the ferrite core 35 in such a manner that a center gap 36*a* of the coil 36 is fit on the inner protrusion 35*b* of the ferrite core 35 and that the coil 36 as a whole is surrounded by and enclosed between the inner protrusion 35*a* and the end protrusion 35*d* of the ferrite core 35.

A first temperature sensor 7 composed of a thermostat is positioned so as to extend through the gap 6*b* of the first coil 6 and through the gap 36*c* of the second coil 36 and so as to face the fixing roller 1. A second temperature sensor 8 faces a part of the outer periphery of the fixing roller 1 that is far from the heating region, as is the case with the embodiment of FIG. 1.

When a paper form of A3 size having the largest width is fed (i.e., when a current is passed through the first coil 6), there are used the protrusions 35*a*, 35*b*, and 35*c* out of the protrusions of the ferrite core 35. When a paper form of B4 size having a width smaller than A3 form has is fed (i.e., when a current is passed through the second coil 36), there are used the protrusions 35*a*, 35*b*, and 35*d* out of the protrusions of the ferrite core 35.

In accordance with the embodiment, a magnetic circuit can be optimized for the first coil 6 and for the second coil 36, individually, though the coil unit is enlarged in comparison with the embodiment of FIG. 10.

Figure 12:
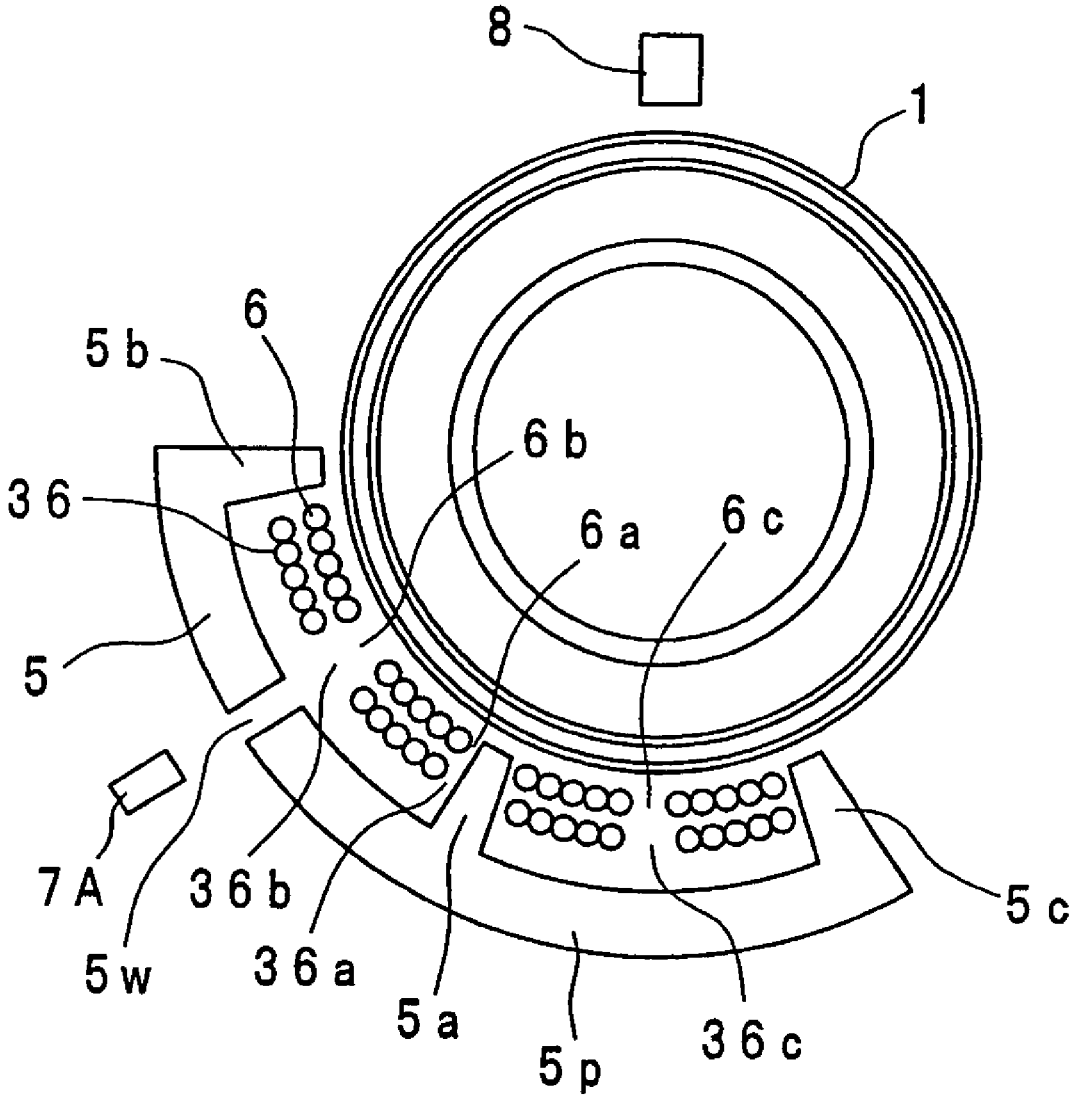
FIG. 12 is a diagram illustrating a fixer of still another embodiment of the invention, the fixer having the second coil of FIG. 9.

FIG. 12 shows a sectional configuration of a fixer in accordance with still another embodiment. In the embodiment, a first temperature sensor 7A of infrared type is provided outside a ferrite core 5, in place of the first temperature sensor 7 composed of the thermostat in the embodiment of FIG. 10.

In a main body 5*p* of the ferrite core 5, a through hole 5*w* is provided in a position corresponding to the first temperature sensor 7 shown in FIG. 3. The first temperature sensor 7A of infrared type detects a temperature of a fixing roller 1 by an infrared method through the through hole 5*w*, a gap 6*b* of a first coil 6, and a gap 36*c* of a second coil 36.

In the fixer, both the first temperature sensor 7A and a second temperature sensor 8 are of infrared type and therefore a configuration of a temperature controlling circuit can be made common to the two temperature sensors 7A and 8. Accordingly, a circuit structure in the fixer can be simplified and the fixer can be configured at low cost.

Figure 13:
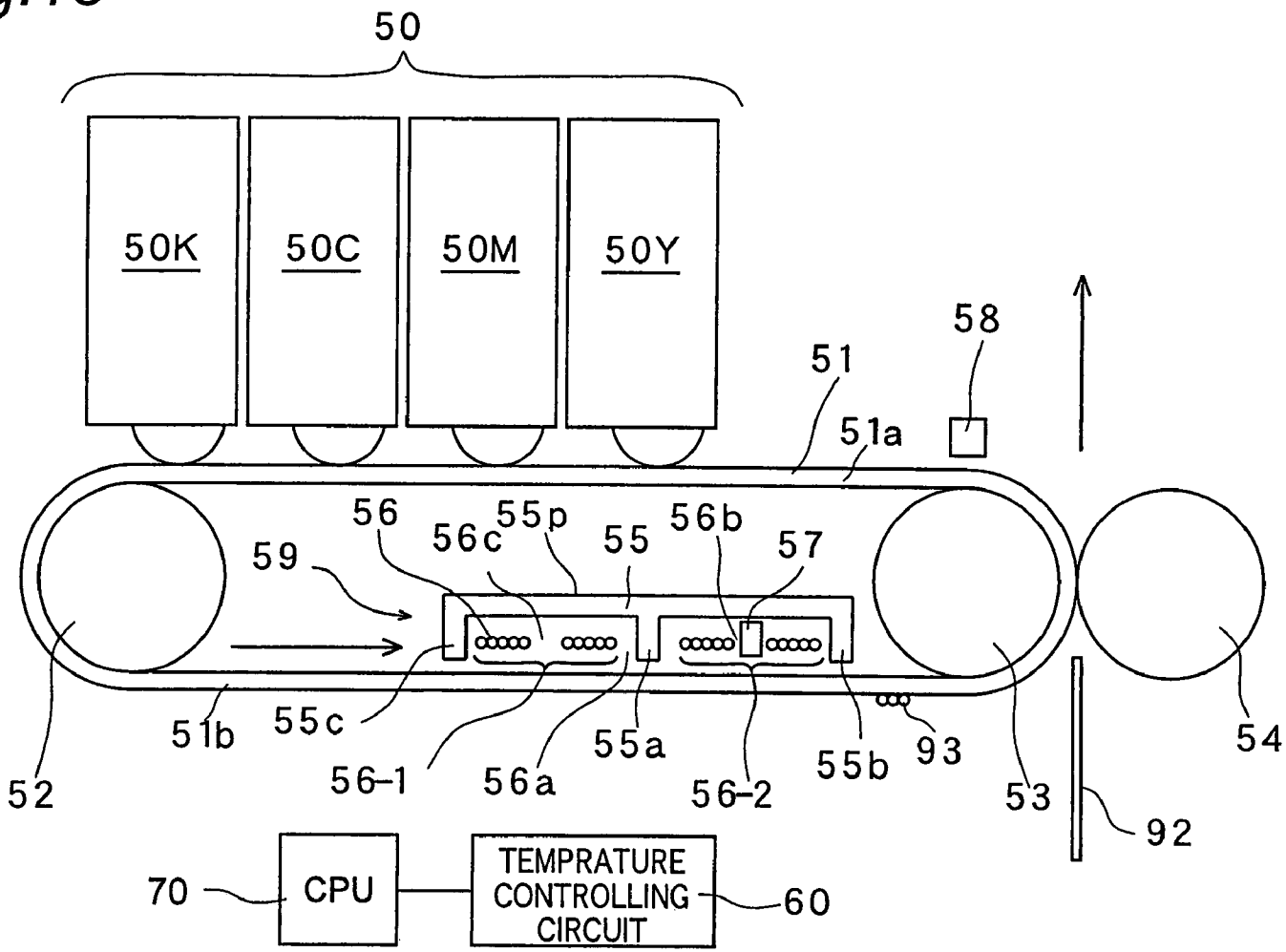
FIG. 13 is a diagram showing a schematic sectional configuration of a color printer as one embodiment of the invention.

FIG. 13 shows a configuration of a color printer as an embodiment of an image forming apparatus of the invention.

The color printer has a four-color developing unit 50 as a image forming unit, loop-like transfer felt 51 as an object to be heated or a fixing member wound around a roller 52 and a fixing roller 53, a cylindrical pressurizing roller 54 as a pressurizing member, a coil unit 59 for induction heating that is positioned so as to extend along a flat section (a lower side section 51*b*) inside the transfer felt 51, a second temperature sensor 58, and guides (not shown) for guiding a paper form 92 as a sheet.

The developing unit 50 has a yellow developing section 50Y, a magenta developing section 50M, a cyan developing section 50C, and a black developing section 50K, which are disposed along a direction of circulation of the transfer felt 51. A toner image 93 with four colors is transferred onto the transfer felt 51 by the developing sections.

The transfer felt 51 is configured like a belt wound around the roller 52 and the fixing roller 53. In the transfer felt 51, for convenience, an upper section between the roller 52 and the fixing roller 53 is referred to as an upper side section 51*a*, and a lower section between the roller 52 and the fixing roller 53 is referred to as the lower side section 51*b*. The transfer felt 51 is driven by the roller 52 and the fixing roller 53 so as to circulate in a direction such that the upper side section 51*a* moves leftward and such that the lower side section 51*b* moves rightward, as shown by an arrow in FIG. 13.

Figure 14:
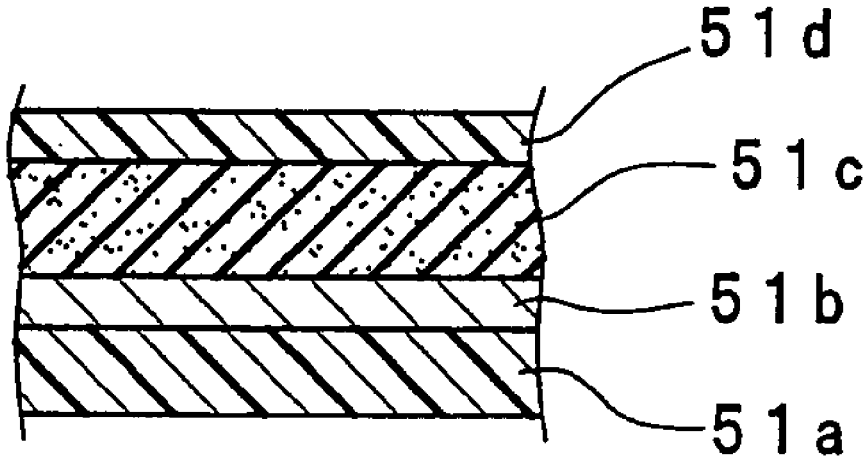
FIG. 14 is a diagram showing a sectional configuration of a part of transfer felt that is a component of the printer of FIG. 13.

As shown in FIG. 14, the transfer felt 51 is composed of a 130-μm-thick PI (polyimide) layer 50*a*, a 20 μm-thick Ni layer 50*b*, a 150-μm-thick Si rubber layer 50*c*, and a 20-μm-thick PFA layer 50*d*. The fixing roller 53, in which a foam Si rubber layer is provided on an iron core metal, is opposed to the pressurizing roller 54 having a configuration similar to that of the fixing roller 53, with the transfer felt 51 between.

In FIG. 13, the pressurizing roller 54 is biased against the fixing roller 53 by a spring not shown, so that a nipping part as a pinching part is formed between the roller 54 and the transfer felt 51 with deformation of the rubber layers. The pressurizing roller 54 is configured so as to be driven by the transfer felt 51. A paper form 92 is conveyed to the nipping part from downside and, after a fixing process, the form 92 is ejected upward.

The coil unit 59 for induction heating has a ferrite core 55 as a holder, a layer-like coil 56 positioned along the flat section (the lower side section 51*b*) inside the transfer felt 51, and a first temperature sensor 57 composed of a thermostat.

The ferrite core 55 has a cross section generally shaped like a letter E as a whole, and extends along axial direction of the fixing roller 53. Specifically, the ferrite core 55 has a main body 55*p* having a cross section shaped like a flat plate and three protrusions extending from the main body 55*p* toward the transfer felt 51, i.e., a center protrusion 55*a* and end protrusions 55*b* and 55*c*.

A configuration of the coil 56 is the same as the configuration of the coil 6 shown in FIG. 3. That is, a center gap 56*a* exists between an outward conductor section 56-1 and a return conductor section 56-2. The coil 56 is wound tight, basically, but a gap 56*b* is provided between an outer conductor section and an inner conductor section in the outward conductor section 56-1 through which electric currents respectively flow in the same direction. A gap 56*c* on the same order as the gap 56*b* is provided between an outer conductor section and an inner conductor section in the return conductor section 56-2 through which electric currents respectively flow in the same direction.

The coil 56 is mounted on the ferrite core 55 with adhesive such as glue in such a manner that the center gap 56*a* of the coil 56 is fit on the center protrusion 55*a* of the ferrite core 55 and that the coil 56 as a whole is surrounded and enclosed by the end protrusions 55*b* and 55*c* of the ferrite core 55.

A first temperature sensor 57 composed of a thermostat is provided in the gap 56*b* of the coil 56 so as to face the transfer felt 51.

A second temperature sensor 58 is provided above the fixing roller 53 so as to face the transfer felt 51.

The color printer has a CPU 70 for controlling operations of the whole printer, and a temperature controlling circuit 60 having the same configuration that the temperature controlling circuit 20 shown in FIG. 5A has.

In a printing operation, the temperature of the transfer felt 51 is controlled to a target temperature according to a printing mode by the temperature controlling circuit 60. Then a paper form 92 is conveyed through the nipping part between the transfer felt 51 and the pressurizing roller 54, and a toner image 93 formed on the transfer felt 51 is thereby transferred onto and fixed to the paper form 92.

On condition that the circulation of the transfer felt 51 is stopped or retarded by failure in a motor or the like, in particular, a heating region of the transfer felt 51 may extraordinarily rise in temperature. In the fixer, the thermostat 57 as the first temperature sensor provided in the gap 56*b* of the coil described above detects temperature of peak of a distribution of generated heat. Therefore, the peak temperature of the distribution of generated heat can be detected accurately. If the peak temperature of the distribution of generated heat exceeds a temperature specified in a predetermined safety standard, the thermostat 57 is turned off and the passage of the current through the coil 56 is thereby interrupted. As a result, stability and safety in the temperature control for the transfer felt 51 can be improved.

The gaps 56*b* and 56*c* are provided between the conductor sections that form the coil 56, so that the coil 56 is cooled by passage of air through the gaps 56*b* and 56*c*. Accordingly, copper loss is restrained from increasing and heat generating efficiency can be kept high.

The gaps 56*b* and 56*c* between the conductor sections that form the coil 56 are formed simply by the change in winding of the coil. Besides, the coil 56 and the temperature sensor 57 are positioned on the same side (inside, in this example) of the transfer felt 51, and therefore the device is not required to have a large scale. As a result, the color printer can be configured at low cost.

The invention being thus described, it will be obvious that the same may be varied in many ways. Such variations are not be regarded as a departure from the spirit and scope of the invention, and all such modifications as would be obvious to one skilled in the art are intended to be included within the scope of the following claims.

What is claimed is:

1. An induction heating device for inductively heating an object to be heated which is formed of conductive material, comprising:

a holder;

a coil for inductively heating the object, the coil being composed of a plurality of turns of conductor forming a layer which is supported by the holder and is positioned along the object, wherein a gap is formed between conductor sections of the coil through which electric currents respectively flow in the same direction, the gap being used for detecting a temperature of the object; and an infrared sensor to detect infrared rays passing through the gap.

2. An induction heating device as claimed in claim 1, wherein the holder comprises a core made of magnetic material.

3. An induction heating device as claimed in claim 1, wherein a temperature sensor is provided in the gap so as to face the object.

4. An induction heating device as claimed in claim 1, wherein the object consists of a body of rotation, and the holder and the coil are positioned outside the body of rotation.

5. An induction heating device as claimed in claim 1, wherein the object consists of a hollow body of rotation, and the holder and the coil are positioned in hollow space in the hollow body of rotation.

6. An induction heating device as claimed in claim 1, wherein the infrared sensor is positioned outside the layer formed by the plurality of turns of the conductor.

* * * * *